United States Patent [19]

Morris et al.

[11] Patent Number: 4,502,194

[45] Date of Patent: Mar. 5, 1985

[54] CHILD PROOF SEAT BELT

[76] Inventors: Roy E. Morris, Rte. 2, Box 149, Cedar Creek, Tex. 78612; Cornelius E. Lynch, Jr., 13201 Wild Turkey Dr., Manchaca, Tex. 78652

[21] Appl. No.: 492,167

[22] Filed: May 6, 1983

[51] Int. Cl.[3] ..... A44B 19/00

[52] U.S. Cl. ..... 24/633; 24/306; 24/166; 220/284; 70/55; 70/159

[58] Field of Search ..... 70/158, 163, 166, DIG. 34, 70/54, 55, 56, 455; 220/284, 285, 286; 297/468; 24/633, 306, 166

[56] References Cited

U.S. PATENT DOCUMENTS

| | | | |
|---|---|---|---|
| 1,239,704 | 9/1917 | Lee et al. | 220/284 |
| 1,291,993 | 1/1919 | Matthews | 70/55 |
| 1,600,761 | 9/1926 | Haase | 220/284 |
| 2,716,882 | 9/1955 | Gill et al. | 70/159 |
| 3,343,384 | 9/1967 | Barr | 70/159 |
| 3,475,934 | 11/1969 | Reisner | 70/455 X |
| 3,718,014 | 2/1973 | Delgadillo | 70/56 |
| 4,014,080 | 3/1977 | Caradec | 297/468 X |

*Primary Examiner*—William E. Lyddane
*Assistant Examiner*—Peter A. Aschenbrenner
*Attorney, Agent, or Firm*—Peter J. Murphy

[57] ABSTRACT

An automobile seat belt includes a latch tongue fixed to one belt segment and having a latching aperture, and a latch housing fixed to the other belt segment, having a recess and opening at its distal end to receive the latch tongue. The tongue is automatically latched within the housing by insertion; and the tongue is released by depressing a release button through an opening in the top face of the latch housing. To render the seat belt child proof, one form of safety cover is a sleeve slipped over the latch housing, the sleeve having one end partially closed to pass the latch tongue and the sleeve having a limited access opening in one face to overlie the release button. The sleeve is retained in enclosing position on the housing by the latch tongue. The limited access opening may be a small opening only large enough to pass the tip of the ignition key to depress the release button and unfasten the belt. The limited access opening may be larger with the housing having means for retaining a child proof safety cap of the type employed for prescription and non-prescription drugs. Another form of safety cover is a band encircling the housing and enclosing the release button opening and secured to the housing in a semi-permanent manner by an adhesive. The band has a limited access opening overlying the release button, and the band itself may be sufficiently stiff to prevent depressing the button through the band, or a stiff aperture plate configured to overlie the release button and adjacent housing may be secured by means of the band. The band may be secured to the housing by a releasable fastening system other than an adhesive cement.

13 Claims, 15 Drawing Figures

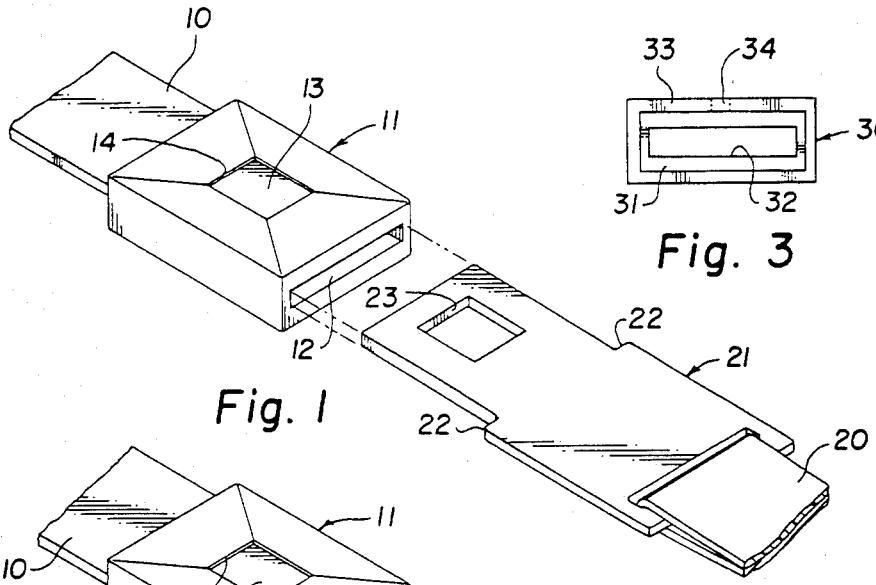
Fig. 1
Fig. 3
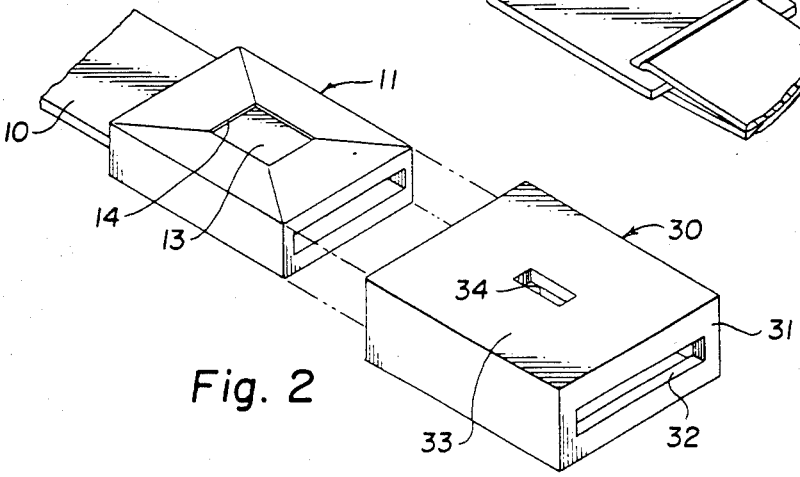
Fig. 2
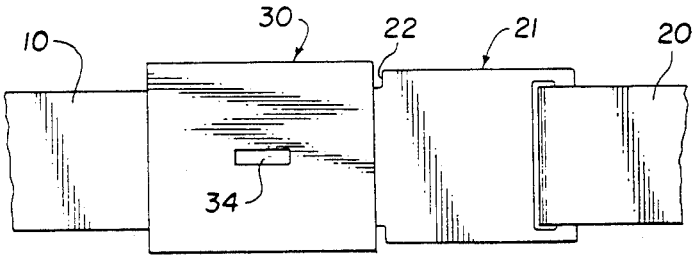
Fig. 4
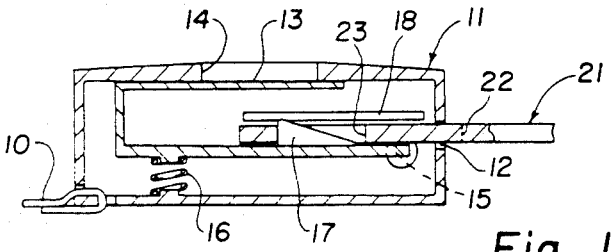
Fig. 1a

CHILD PROOF SEAT BELT

This invention relates to an automobile safety belt for small children; and more particularly to a standard automobile seat belt including attachments for preventing the unfastening of the belt by a small child.

A standard automobile seat belt consists of a latch housing fixed to one of the belt segments and a latch tongue fixed to the other of the belt segments to be inserted into the latch housing to be automatically latched therein for the fastening of the seat belt. To release the latch and unfasten the seat belt, a spring loaded release button is exposed to one face of the latch housing to be depressed by the belt user or other occupant of the automobile.

When small children reach the age to travel in automobiles and be fastened with the seat belts in the usual manner, they learn very soon the function of the belt release button and have the ability, at a very early age, to depress the release button and release themselves from the seat belt. As children are very wont to do, they will stand up and likely climb around the automobile; and this can be dangerous for the children in the event of swerves or stops and particularly of course in the event of a collision.

It is very desirable, therefore, to have some means to prevent young children from unfastening the standard automobile seat belt, which means may be used readily for the purpose of securing a child in an automobile seat, and which will not interfere with the normal use of the seat belt by an adult.

An object of this invention is to provide an attachment for use with a standard seat belt for substantially preventing the unfastening of the seat belt by a child.

Another object of this invention is to provide such attachment for a standard seat belt for use when a child is to be secured in an automobile seat, and which will enable normal functioning of the seat belt for use by an adult.

A further object of this invention is to provide such attachment for an automobile seat belt which is simple in design and economic to manufacture.

Still another object of this invention is to provide a method for rendering child proof a standard automobile seat belt.

A still further object of this invention is to provide such attachment for a standard automobile seat belt which may be readily attached to the seat belt by the owner of the automobile.

These objects are accomplished in a safety cover for use with a standard seat belt which includes a latch housing fixed to one belt segment and a latch tongue fixed to the other belt segment. The latch tongue has a latching aperture and is configured to be received within the latch housing. The latch housing includes a spring biased latching dog for latching engagement with the tongue aperture, and a release button exposed to one face of the latch housing to effect release of the latching dog from the latching aperture.

Broadly, the safety cover encloses the release button in the one housing face, and is provided with a limited access release aperture disposed to overlie the release button. The release aperture provides limited access to the release button to effect the unlatching of the safety belt.

More particularly, the safety cover may consist of a sleeve dimensioned to enclose the latch housing relatively closely and having one partially closed end provided with an aperture to pass the latch tongue. The sleeve is retained in place over the latch housing by means of the engaged latch tongue.

Also more particularly the safety cover may consist of a band partially encircling the latch housing, and secured to the housing by means of a suitable adhesive to maintain the release aperture in the desired overlying relation.

These objects are also accomplished in a method for rendering child proof a standard automobile seat belt, which includes the following steps. The release button in the one face of the latch housing is enclosed with a safety cover secured to the housing. A limited access release aperture is formed in the safety cover, disposed to overlie the release button, and provide limited access to the release button. More particularly the safety cover is fabricated as a band partially encircling the housing and enclosing the push button. Still more particularly a stiff aperture plate is fixed to the band, and positioned to overlie the release button and prevent compression of the button through the band. Also more particularly, the latch housing is enclosed with a close fitting sleeve provided with the release aperture; and the sleeve is retained on the housing by the latch tongue.

The novel features and the advantages of the invention, as well as additional objects thereof, will be understood more fully from the following description when read in connection with the accompanying drawings.

DRAWINGS

FIG. 1 is a perspective view of a typical seat belt with separated latch housing and latch tongue;

FIG. 1*a* is a longitudinal sectional view of the latch housing;

FIG. 2 is a perspective view of the latch housing of FIG. 1 and a separated housing cover;

FIG. 3 is an end view of the latch housing cover, as viewed from the open end;

FIG. 4 is a top view of a latched latch housing and latch tongue, with the housing enclosed by the cover of FIGS. 2 and 3;

DESCRIPTION OF THE PREFERRED EMBODIMENTS

Embodiment of FIGS. 1 through 4

Figure 5:
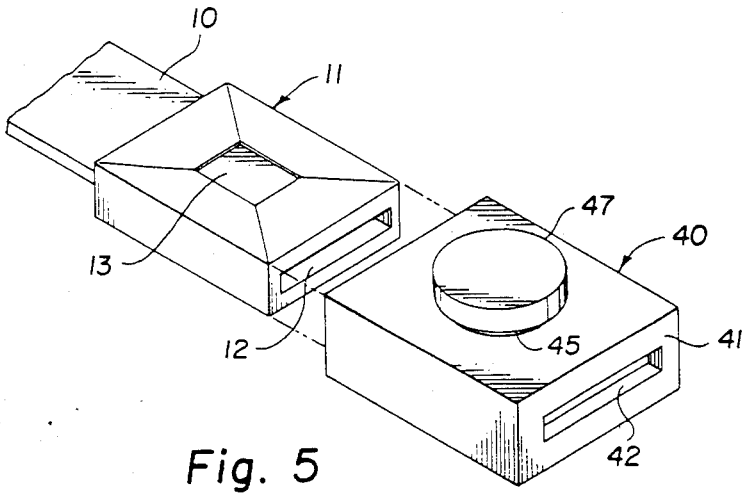
FIG. 5 is a perspective view of a latch housing and alternative form of housing cover, shown separated from the housing.

FIG. 1 of the drawing illustrates a typical conventional seat belt of the type installed in passenger automobiles. The latching members of the seat belt include a latch housing 11 fixed to one segment 10 of the seat belt, and a latch tongue 21 fixed to the other segment 20 of the seat belt. Typically the latch housing 11 is generally rectangular in shape, being attached to the belt segment 10 at one end, and having a recess 12 at the other end for receiving a portion of the tongue 21. The tongue 21 is a flat member including a wider portion at its proximal end which is attached to the belt segment and a narrower portion at its distal end to be received in the housing recess 12, and forward facing shoulders 22 between the distal and proximal portions. The tongue is provided with a rectangular latching aperture 23 in the distal portion, adjacent to its distal end.

A latching mechanism within the latch housing 11 which coacts with the latching aperture 23, includes a spring biased dog to be received in and engage the latching aperture 23 and a release button 13 to effect disengagement of the latching dog from the tongue aperture 23. The release button is exposed to the upper face of the latch housing 11 which is provided with an opening 14 and dimensioned to readily pass the finger of an adult user to depress the button 13. In actual construction, a single movable member within the latch housing may include the latching dog, and also include an element which defines the so-called push button 13 which coacts with the opening 14.

FIG. 1*a* illustrates such a mechanism, FIG. 1*a* being a longitudinal sectional view through the latch housing 11, with the tongue 21 inserted therein. It will be seen in FIG. 1*a* that the member 13, which defines the push button, is a U-shaped member having an upper leg which is urged against the upper housing wall closing the recess 14. The lower leg of this U-shaped member is provided with laterally opposed ears 15 which function as journals seated in suitable bearing recesses within the housing 11 providing a pivot mounting for the member 13. A biasing spring 16 urges the member 13 to the illustrated position which is the normal position. A wedge-shaped dog 17 projects upwardly from the lower leg of the member 13. Ribs 18, fixed to the side walls of the housing 11, provide stops to limit upward movement of the tongue 21 when inserted into the housing.

It will be seen that when the tongue 21 is inserted into the opening 12 of the housing, it is guided between the lower leg of the member 13 and the ribs 18. When the distal end of the tongue engages the dog 17 the member 13 is cammed downwardly allowing the distal end of the tongue to pass over the dog; and the spring 16 will then urge the member upwardly to move the dog 17 into the aperture 23 in the illustrated latched position.

It will be seen further that by depressing the release button 13, that entire member will be pivoted downward about the journal ears 15 releasing the lug 17 from the tongue to allow unfastening of the seat belt. As seen in FIGS. 1 and 1*a*, the so-called release button 13 is within the recess 14 and thereby protected to prevent accidental release and fastening of the seat belt.

FIGS. 2 and 3 illustrate a safety cover in the form of a sleeve 30 to be used in association with the above described latch housing 11. This sleeve is generally rectangular in shape having one partially closed end 31 provided with a slot 32 dimensioned to readily pass the distal narrower end portion of the tongue 21, and having a top wall 33 provided with a small elongated slot 34 at about the center thereof. The sleeve is fabricated to have relatively stiff walls; and is readily adapted to be fabricated very economically from a plastic material by injection molding.

The sleeve is configured to be slipped over the latch housing 11 from its distal end; and is dimensioned to receive the latch housing in relatively close fitting relation. When the sleeve 30 fully enclosed the housing 11, its end wall 31 will be against the distal end of the sleeve housing; and the small elongated slot 34 will be disposed in overlying relation to the push button 13.

It will be seen that the area of the slot 34 is much smaller than that of the opening 14 for the push button; and this opening 34 is configured to provide a limited access release aperture, functioning to limit the means by which the release button 13 may be depressed with the sleeve in operative position as illustrated in FIG. 4. Actually, the slot 34 in FIG. 2 is configured and dimensioned to conveniently receive the tip of the automobile ignition or door key which, of course, is conveniently available for use when desired to effect the unfastening of the seat belt by release of the seat belt latch.

As mentioned, the material of the sleeve 30 is preferably relatively stiff so that the release button 13 may not be pressed merely by exerting sufficient external pressure on the sleeve in the area of the slot 34. Since the release button is recessed relative to the upper face of the latch housing, it is most unlikely that the seat belt could be unfastened in this manner.

FIG. 3 illustrates the assembled and latched seat belt, with the sleeve 30 in operative position enclosing the latch housing 11. It will be seen that the shoulders 22 of the latch tongue 21 maintain the sleeve in the correct position with the limited access slot 34 overlying the release button.

The limited access release aperture 34 is illustrated as an elongated slot by way of example. This small aperture may have other shapes which would enable the release button to be depressed by insertion of the narrow tip of any suitable implement. It is apparent that this safety sleeve will be very effective for use with a very young child who would be unable to manage an implement for releasing the seat belt. Even when the child is older and acquires the capability for releasing the belt with a suitable implement, this seat belt assembly will still be very effective simply by preventing the child from having access to such an implement.

Figure 6:
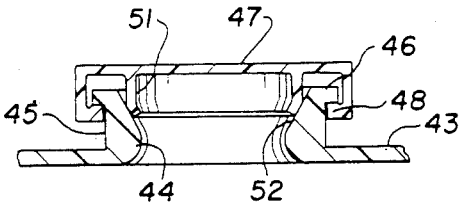
FIG. 6 is a fragmentary sectional view of the top wall of the housing cover, showing the access opening and cap.
Figure 7:
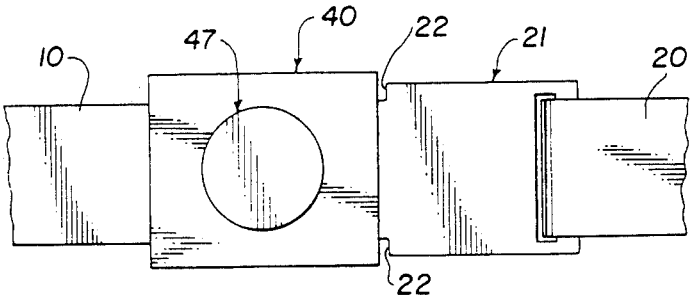
FIG. 7 is a top view of a latched latch housing and latch tongue, with the housing enclosed by the cover of FIGS. 5 and 6.

Embodiment of FIGS. 5 through 7

FIGS. 5, 6 and 7 of the drawing illustrate another form of safety sleeve 40 for use with the seat belt illustrated in FIG. 1. The sleeve 40 has a body of the same rectangular configuration illustrated in FIGS. 2 and 3, including an end wall 41 having an elongated slot 42 dimensioned to pass the smaller distal portion of the belt latch tongue 21.

A limited access release aperture 44 provided in the top wall 43 of the sleeve is much larger than the aperture previously described, being large enough to pass the finger of an adult user of the seat belt. A peripheral neck 45 is associated with and surrounds the aperture 44 and is provided with latching lugs 46 for coaction with complementary latching lugs 48 provided on the skirt of a coacting closure cap 47. The neck 45 and its associacted lugs 46 and the cap 47 and its associated lugs 48 having configurations similar to that which might be provided on vials for either prescription or nonprescription drugs having safety caps for prevention of access by small children. The coacting neck 45 and closure cap 47 are illustrated and described in detail in U.S. Pat. No. Re. 30,625 issued May 26, 1981; and that patent is incorporated herein by reference. As illustrated in FIG. 6, the parts are preferably fabricated from plastic; and a biasing force tending to urge the cap upward relative to the neck is provided by the coaction of an annular wall 51 dependent from the cap 47 and coacting with the annular beveled internal surface 52 of the neck 45. The latching lugs 46 and 48 coact to prevent rotation of the cap, unless the cap is moved axially downward relative to the housing wall 43 against the biasing force provided by the member 51 and surface 52. The coaction of the cap 47 with the neck 45 renders the aperture 44 a limited access aperture with respect to small children.

Figure 8:
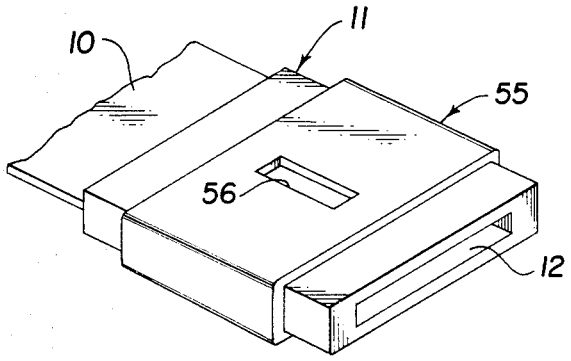
FIG. 8 is a perspective view of a seat belt latch housing with an alternative form of latch cover.
Figure 9:
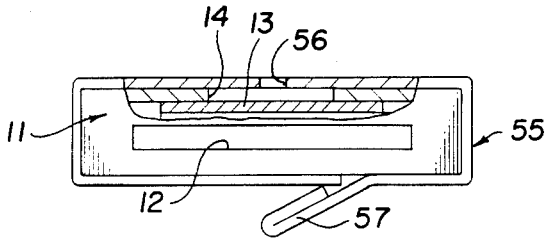
FIG. 9 is an end view of the assembly of FIG. 8, partially broken away.

Embodiment of FIGS. 8 and 9

FIGS. 8 and 9 of the drawing illustrate another form of child proof seat belt according to the invention including the conventional latch housing 11 and latch tongue 21 described above. A safety cover 55 for the latch housing consists of an elongated strip or band fabricated from some suitably strong and rigid material such as a strong fabric or possibly a plastic material, which band has a sufficient width to span and overlie the opening 14 for the push button 13 of the latch housing. This band may be 1¼ inches wide for example. The band is tightly secured to the housing 11 in any suitable manner, such as a suitable bonding cement preferably a pressure sensitive adhesive. The band 55 is provided with a small aperture 56 disposed, in assembled relation, to overlie the push button 13. The aperture 56 is a release aperture configured and dimensioned to receive the small tip of a suitable implement to be inserted through the aperture to depress the push button 13. As illustrated in the drawing, the aperture is an elongated rectangular slot dimensioned and configured to receive the tip of the automobile ignition key for example.

As illustrated in the drawing, the band 55 is sufficiently long to more than encircle the housing 11 and enable the forming of an overlapping tab 57 on the undersurface of the housing. Desirably, the band is furnished with a pressure sensitive adhesive coating; and the tab 57 is readily formed by folding one end of the band back on itself, as illustrated in FIG. 9. This tab 57 provides a means to grasp one end of the band 55 and remove the band from the housing 11 in the event of an emergency requiring quick release of the seat belt, particularly where the necessary pointed implement may not be immediately available. With this arrangement, the band functions well as a safety cover since the tab 57 is on the underside of the housing 11 and would be difficult if not impossible to remove by the child using the seat belt. As mentioned, the material of the band 55 should be suitably stiff so that the push button cannot be depressed sufficiently to release the seat belt latch simply by pressing on the surface of the band at the aperture 56.

Figure 10:
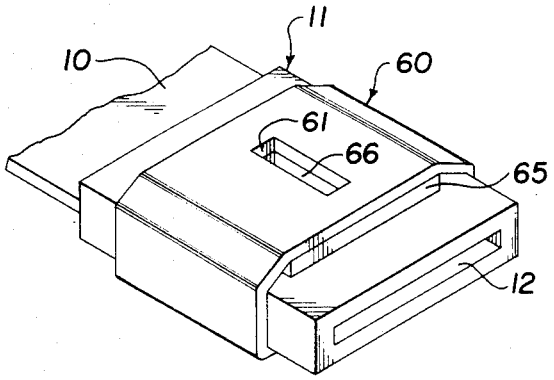
FIG. 10 is a fragmentary view of a latch housing with still another alternative form of latch cover.
Figure 11:
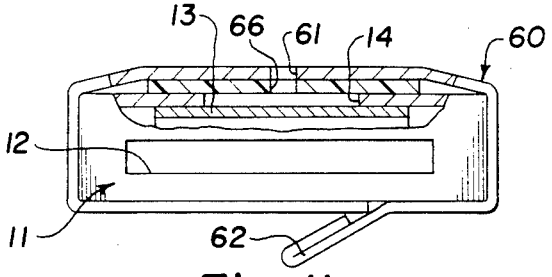
FIG. 11 is an end view of the assembly of FIG. 10, partially broken away.

Embodiment of FIGS. 10 and 11

FIGS. 10 and 11 of the drawing illustrate a modified form of safety cover similar to that of FIGS. 8 and 9. As seen in the drawing, the safety cover again includes a band 60, similar to the above described band 55, and provided with a similar release aperture 61. Again, this band 60 has a length more than sufficient to encircle the housing 11, providing an overlapping tab 62 on the underside of the housing 11 to facilitate emergency removal of the band 60 Again, the band 60 is secured to the housing 11 by means of a suitable bonding cement, preferably a cement which may be pressure sensitive and nonhardening, and therefore enabling reasonably facile release of the band if necessary. An additional element of the safety cover assembly is an aperture plate 65, which is preferably a small sheet of plastic material which may be square and dimensioned to overlie the opening 14 for the push button 13 and additionally a portion of the housing face which surrounds that opening 14. By way of example such aperture plate 65 may be 1¼ inch square and about 1/16 inch thick. The aperture plate is preferably bonded to the band 60 by means of the same adhesive which bonds the band to the housing; and the aperture plate will be held in place by the bonded band. The aperture plate is, of course, provided with a release aperture 66 corresponding in size and shape to the aperture 61 of the band and directly underlying the band. Since, in this combination, the aperture plate 65 provides the desired stiffness of the safety cover to prevent depressing of the release button 13 merely by finger pressure, the band 60 may be fabricated from a softer woven material for example.

Figure 12:
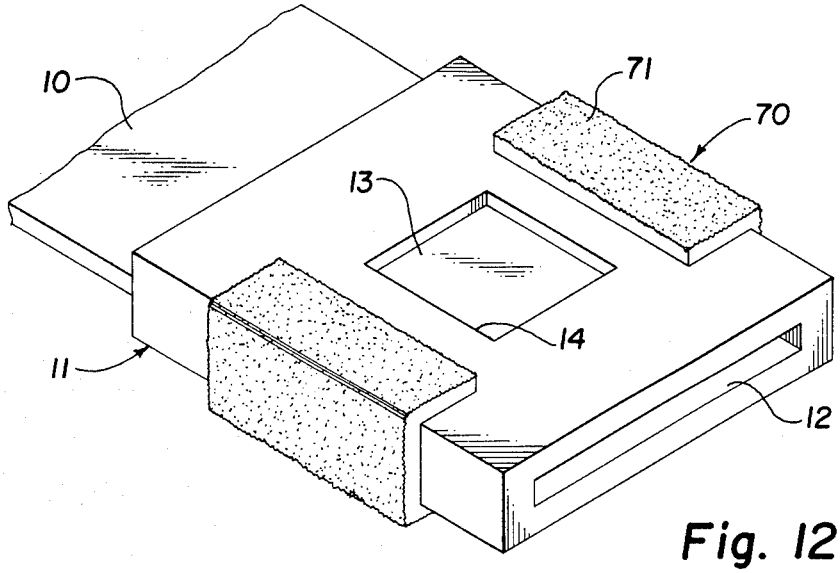
FIG. 12 is a perspective view of a latch housing with a portion of another alternative form of latch cover assembly.
Figure 13:
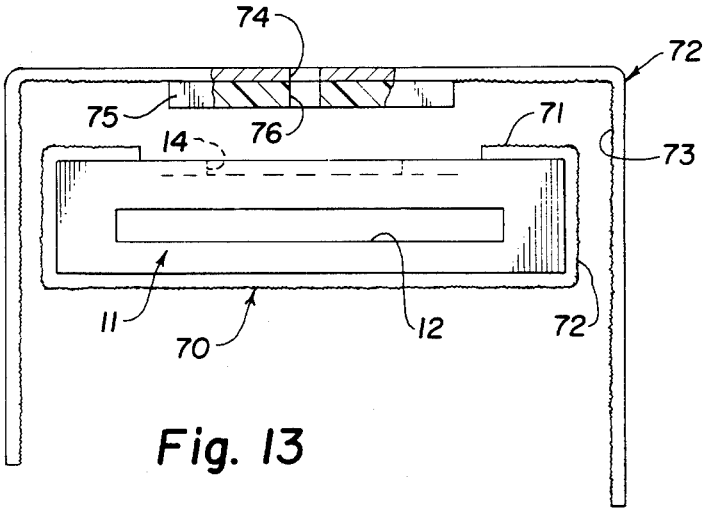
FIG. 13 is an end view of the assembly of FIG. 12, and an additional separated portion of the latch cover assembly.
Figure 14:
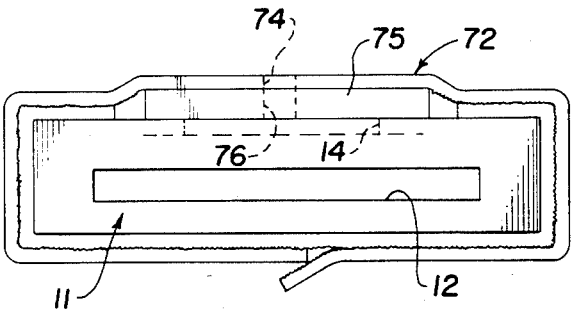
FIG. 14 is an end view of the assembly of FIG. 13 in assembled relation.

Embodiment of FIGS. 12 through 14

FIGS. 12 through 14 illustrate another modified form of safety cover according to the invention, somewhat similar to that of FIGS. 10 and 11 but utilizing a fastener system of a type which is marketed under the trademark Velcro.

As seen in the drawing, this safety cover consists of two bands, each of which is provided with an adhering surface on one face, and which adhering surfaces coact with each other when compressed together to prevent relative sliding movement, and to resist separation effected by pulling one strip away from the other, which may be referred to as a perpendicular separating force.

As seen in the drawings, a first strip or band 70 may consist of a strip or band fabric material provided with a first adhering surface 71 on one face, which is the exterior face in assembled relation. The opposite or interior face of the band 70 is bonded to the housing 1 by means of a suitable bonding cement, for example; and this band is bonded to the housing in a manner that the ends of the band terminate on the top or push button face of the housing spaced from the side edges of the push button opening 14.

Alternative to the fabric band 70, it may be possible to provide to form the adhering surface 71 directly on the exterior surface of the housing 11.

A second band 72 preferably consists of an elongated fabric strip having a second adhering surface 73 formed on one face thereof. This band 72 may have a length to substantially encircle the housing 11. A release aperture 74, configured to receive the tip of an ignition key for example, is formed intermediate the ends of the band 72; and an aperture plate 75, similar to the previously described aperture plate 65, is bonded to the band 72 by means of a suitable cement. The aperture plate 75 is provided with a release aperture 76 coinciding with the release aperture 74.

As previously described, the aperture plate 75 is configured to overlie the push button aperture 14 and a portion of the surrounding housing; and in this configuration the ends of the first band 70 are separated sufficiently to allow the placement of the aperture plate 75 in contiguous relation to the housing 11 overlying the opening 14.

The outer band 72 is secured to the inner band 70 merely by pressing the two bands together as best seen in FIG. 14; and the coaction of the first and second adhering surfaces 71 and 73 will securely retain the outer band 72 in the assembled relation. The adhering force of the two bands is sufficient to prevent removal by a child using the seat belt; and yet this outer band 72 is readily removed by an adult in the event that that should become necessary in an emergency.

To enable convenient installation of the above described safety cover bands 55, 60 and 71, these bands may be fabricated with a pressure sensitive adhesive coating protected by a removable plastic or paper strip, so that these bands may be easily secured to a seat belt latch housing.

Method Embodiment

The above described seat belt and safety cover assemblies are examples of apparatus which may be used for practicing a method to render child proof a standard automatic seat belt. A method for accomplishing that result may include the following steps: enclosing the release button in the one face of the latch housing with a safety cover; forming a limited access release aperture in that cover disposed to overlie the release button, which release aperture thereby provides limited access to the release button; fabricating the cover from a material that is sufficiently stiff to prevent depressing the button by means of the cover; and configuring the release aperture to pass the small tip of an instrument used for depressing the release button, more particularly as a small elongated slot dimensioned to pass the tip of an automobile key which is conveniently available for that purpose.

The method may also include the steps: enclosing the seat belt latch housing with a cover in the form of a close fitting sleeve; configuring that sleeve with an end wall and aperture to pass the latch tongue whereby the sleeve is retained on the housing by the latched latch tongue; and forming on that sleeve a neck means in association with the release aperture to support and retain a child proof closure cap, and closing that release aperture with a child proof closure cap.

The method may also include the steps: fabricating the safety cover as a band having the release aperture intermediate its ends, and securing the band to the housing by means of a releasable adhesive; fabricating that band from a flexible woven material and securing to that band a rigid aperture plate; dimensioning that aperture plate to overlie the release button and a portion of the surrounding latch housing, and forming a release aperture in that aperture plate coinciding with the release aperture of the band.

The method may also include the steps: providing a band with a first adhering surface encircling the exterior of the latch housing in intersecting relation with the push button; partially encircling the housing with a band having a second adhering surface which is formed to adhere to the first adhering surface in response to compressive force and to release from that first adhering surface in response to perpendicular separating force, and forming the release aperture in that band having the second adhering surface; providing that band of a first adhering surface as a separate band or strip of material and forming that first adhering surface thereon, and bonding that band to the housing by means of a suitable adhesive; and forming that band having the second adhering surface as a second band selectively joined and removed from that first band by means of said coacting first and second adhering surfaces; and securing a stiff aperture plate to that second band, and dimensioning the aperture plate to overlie the push button and the surrounding portion of the housing; and forming a release aperture in the aperture plate coinciding with the release aperture of the second band.

What has been described is a novel apparatus and method for providing a seat belt which is safe for young children, since it inhibits or prevents the unfastening of the seat belt by a child.

An important feature and advantage of the invention is that the attachment for the seat belt is very easily and readily assembled with the seat belt for use to secure a child, is very effective for that purpose, and that the seat belt is very readily and easily unfastened by an adult when desired.

A particular feature and advantage of the apparatus of FIGS. 2 through 7 is that the safety sleeve is a simple attachment which may be added to the seat belt assembly for use in securing a child in an automobile, and which is not used when the belt is used in the normal fashion to secure an adult. The attachment may be readily stored in the glove compartment or other convenient place for use when desired.

A particular feature and advantage of the apparatus of FIGS. 12 through 14 is similar, namely that the outer band 72 may be assembled with the latch housing when using the belt to secure a child, and that this outer cover may be readily removed from the housing and stored in the glove compartment to enable conventional and normal use of the seat belt by an adult.

Another feature and advantage of the apparatus of FIGS. 12 through 14 is that when the belt is used to secure a child, and for some reason it is necessary to release the seat belt rapidly and a suitable releasing implement such as the ignition key is not available, the outer band 72 may be quickly removed by an adult and the belt released in the normal fashion. This feature is available in that situation; and yet the outer band 72 is secured sufficiently firmly so that it cannot be removed by a small child.

A similar feature and advantage applies to the apparatus of FIGS. 8 through 11 wherein the bands 55 or 60 are secured to the housing sufficiently firmly that they cannot be removed by a child who is secured by the seat belt. Yet these bands, when secured to the housing by a suitable releasable adhesive, may be removed by an adult in the event of emergency to enable unfastening of the seat belt when a suitable small implement is not available.

Another feature and advantage of the invention is that all forms of safety cover attachments according to the invention may be fabricated in a manner to be sold as attachments to seat belts, which may be purchases in any auto supply store or other outlet, and which may be attached to the seat belt latch housing in an effective manner by any owner of an automobile or other vehicle. The bonding adhesive for the bands 55, 60, and 70 may be in the form of a pressure sensitive adhesive pre-applied to the bands and covered by a protective strip of paper or plastic film. The protective strip may be easily removed by the user when applying the band to the latch housing.

While the preferred embodiments of the invention have been illustrated and described, it will be understood by those skilled in the art that changes and modifications may be resorted to without departing from the spirit and scope of the invention.

What is claimed is:

1. For use with a seat belt which includes a latch housing and a coacting latch tongue fixed to respective seat belt segments; said latch tongue being insertable in said latch housing to fasten said seat belt, and said latch housing having an end opening to pass said latch tongue; said latch housing having a release button exposed to one face thereof, dimensioned to be depressed by a thumb or finger to release said latch tongue from said latch housing;

a safety cover enclosing said release button in said one housing face; said cover having a release aperture disposed to overlie only a small portion of said release button; said release aperture enabling depression of said release button only by an instrument dimensioned to pass through said release aperture;

said safety cover comprising a band secured to one face of said housing.

2. Apparatus are set forth in claim 1 said band being secured to said housing by means of a releasable adhesive.

3. Apparatus as set forth in claim 1 said band encircling said housing.

4. Apparatus as set forth in claim 3 said band comprising an elongated strip having a length greater than the housing circumference, thereby providing an overlapping release tab disposed on the bottom face of said housing to facilitate the release of said band from said housing.

5. Apparatus as set forth in claim 1 a stiff aperture plate fixed to said band intermediate its ends, configured to overlie said housing release button and a portion of said housing surrounding said release button; said aperture plate being provided with a release aperture coinciding with said release aperture of said band.

6. Apparatus as set forth in claim 1 said cover comprising first and second bands;

said first band being secured to and partially encircling said housing, not enclosing said release button;

said first band having a first adhering surface on its exposed surface;

said second band having a second adhering surface; said first and second adhering surfaces coacting to adhere to each other in response to relative compressive force, and to release from each other in response to relative perpendicular separating force;

said second band partially overlying said first band and enclosing said release button; and said second band having said release aperture overlying said release button.

7. Apparatus as set forth in claim 6 said second band having a length substantially greater than the housing circumference, thereby providing an overlapping release tab disposed on the bottom face of said housing to facilitate the release of said second band from said first band.

8. Apparatus as set forth in claim 6 a stiff aperture plate fixed to said second band intermediate its ends configured to overlie said housing release button and a portion of said housing surrounding said release button; said aperture plate being provided with a release aperture coinciding with said release aperture of said second band.

9. Apparatus as set forth in claim 1 said housing being provided with an external band of a first adhering surface aligned with said push button;

a band having a second adhering surface; said first and second adhering surfaces coacting to adhere to each other in response to compressive force, and to release from each other in response to perpendicular separating force;

said band partially overlying said first adhering surface and enclosing said release button; and said band having said release aperture overlying said release button.

10. A method for rendering child proof a standard automobile seat belt which consists of a latch housing fixed to one belt segment and a latch tongue fixed to the other belt segment, said tongue being insertable in said housing to effect automatic fastening of the belt; said housing having a release button exposed to one face thereof, depressible by a finger or thumb, to effect release of the tongue from the housing; the method comprising the steps enclosing said release button in said one housing face with a safety cover;

forming a limited access release aperture in said cover disposed to overlie only a small portion of said release button; said release aperture enabling depression of said release button only by an instrument dimensioned to pass through said release aperture;

fabricating said cover as a band having said release aperture intermediate its ends; securing said band to said housing.

11. A method as set forth in claim 10, including the steps securing the rigid aperture plate to said band intermediate its ends; configuring said aperture plate to overlie said release button and a portion of the surrounding housing; forming a release aperture in said aperture plate coinciding with said release aperture of said band.

12. A method as set forth in claim 10, including the steps forming a band of a first adhering surface on the exterior of said housing to intersect said push button;

partially encircling said housing with a cover band having a second adhering surface formed to adhere to said first adhering surface in response to compressive force and to release from said first adhering surface in response to perpendicular separating force;

forming said release aperture in said cover band.

13. A method as set forth in claim 12 including the steps securing a stiff aperture plate to said cover band; configuring said aperture plate to overlie said push button and the surrounding portion of said housing; and forming coinciding release apertures in said band and said aperture plate.

* * * * *